United States Patent [19]

Song

[11] Patent Number: 4,955,677

[45] Date of Patent: Sep. 11, 1990

[54] SAND PAPER ORGANIZER AND DISPLAY RACK

[76] Inventor: In W. Song, 6038 Santa Monica Blvd., Los Angeles, Calif. 90038

[21] Appl. No.: 227,061

[22] Filed: Aug. 1, 1988

[51] Int. Cl.[5] ..... A47B 81/00

[52] U.S. Cl. ..... 312/290; 312/278; 211/55; 211/128

[58] Field of Search ..... 312/290, 278, 119, 118, 312/211, 212, 289, 330 R, 312, 240, 251; 211/50, 55, 128

[56] References Cited

U.S. PATENT DOCUMENTS

| | | | |
|---|---|---|---|
| 263,591 | 8/1882 | Roeder, Sr. | 211/55 |
| 557,095 | 3/1896 | Tate | 312/290 |
| 927,671 | 7/1909 | Nicholson | 211/55 |
| 1,131,713 | 3/1915 | Kramer | 312/290 |
| 1,528,618 | 3/1925 | Knaster | 312/290 |
| 1,785,666 | 12/1930 | Bachelder | 312/290 |
| 1,866,464 | 7/1932 | Hallowell et al. | 312/330 |
| 1,955,370 | 4/1934 | Snook et al. | 211/128 |
| 2,333,717 | 11/1943 | Heed et al. | 312/278 |
| 3,012,348 | 12/1961 | Smith | 211/50 |
| 3,210,865 | 10/1965 | Muntz | 211/55 |

*Primary Examiner*—Kenneth J. Dorner
*Assistant Examiner*—Brian K. Green
*Attorney, Agent, or Firm*—Julius Rubinstein

[57] ABSTRACT

A cabinet for displaying articles which can be used in two positions. The cabinet is provided with a plurality of divider walls dividing the cabinet into a plurality of differently sized article receiving pigeonholes or slots. The cabinet is constructed so that depending on the position of the cabinet the articles will be displayed in a horizontal or vertical position. The cabinet has at least two identically sized drawer receiving slots, each sized to receive a drawer. The drawer receiving slots are disposed perpendicular to each other and are positioned so that regardless of whether the cabinet is in one position or another one of the drawer receiving slots is along side a wall of the cabinet and the other drawer receiving slot is horizontal in the cabinet. In this way a drawer can always be inserted in a horizontal drawer receiving slot regardless of the position of the cabinet.

3 Claims, 1 Drawing Sheet

SAND PAPER ORGANIZER AND DISPLAY RACK

This invention relates to a cabinet and more particularly to a organizer and display cabinet.

BACKGROUND AND BRIEF SUMMARY

Cabinets for the storage, organization, and display of various materials are well known in the art. Typical examples of such cabinets are exemplified by the U.S. Pat. Nos. to Denhoff Des. 279,529, Adams 786,176, Stayton Des. 159,691, Sussman Des. 252,435, Nelson Des. 282,989, Kates Des. 257,814, Taylor 1,414,160, and Isaacs 3,874,758.

However there is a need for a cabinet which can be mounted in two positions transverse to each other wherein the cabinet is provided with dividers for the organization of the material. In one position, as shown in FIG. 1, depending on the nature of the articles to be stored or organized in the cabinet, the material such as, Christmas cards would be stored in the dividers in a vertical position. In another position, as shown in FIG. 2, the articles, such as various sizes of stationary or sandpaper and the like would be stored in a horizontal position. In either position, there is a need for one or more horizontal storage drawer which if desired can be locked to store money, stamps, or various kinds of liquids.

What is needed, therefore, and comprises an important object of this invention is to provide a cabinet which can be mounted in two positions, each position transverse to each other, yet in each position the lockable storage drawer or drawers would be horizontal.

These and other objects of this invention will become more apparent when better understood in the light of the accompanying drawings and specification wherein.

Figure 1:
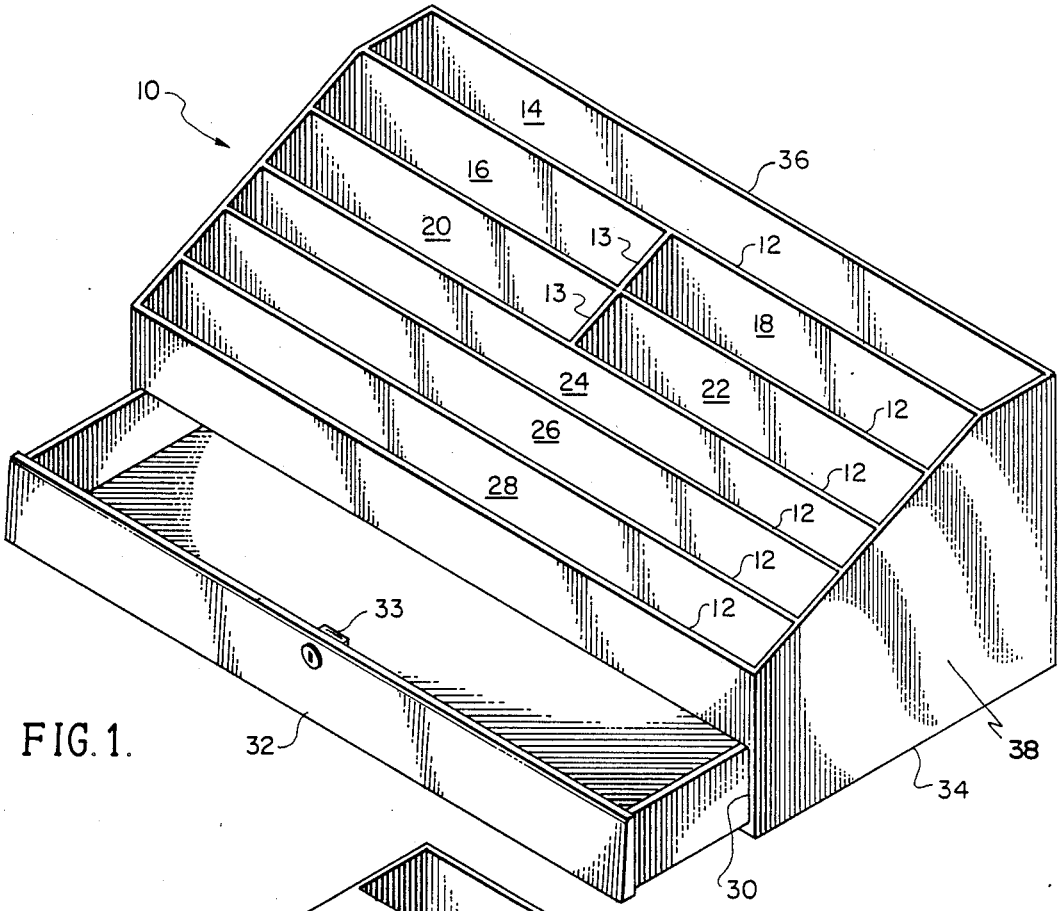
FIG. 1 is a perspective view of the novel cabinet in one position and showing the lockable storage drawer in a horizontal position while the dividers are disposed in a vertical position.

Referring now to FIG. 1 of the drawing, a cabinet indicated generally by the reference numeral is provided with a plurality of vertical dividers 12 defining article receiving pigeon holes or slots 14,16,18,20,22,24,26,28,and 30 all of which may have different depths or dimensions. It is noted that slots 14,24,26, 28 and 30 extend the full width of the cabinet, whereas slot 16, 18,20, and 22 are only half the width being separated by dividers 13. The cabinet 10 is provided with slots 14 and 30 which in this embodiment are perpendicular to each other. These particular slots are drawer receiving slots sized to receive full width drawers 32 although the principles of this invention can be practiced with drawers and drawer receiving slots which are not the width of the cabinet. In addition, the drawing shows a cabinet with only one drawer and two transverse drawer receiving slots, it is also contemplated that the principles of this invention can be practiced by constructing a cabinet with a plurality of pairs of transverse slots so that as will become apparent below, the cabinet could have a plurality of horizontal locking drawers regardless of the orientation of the cabinet.

Figure 2:
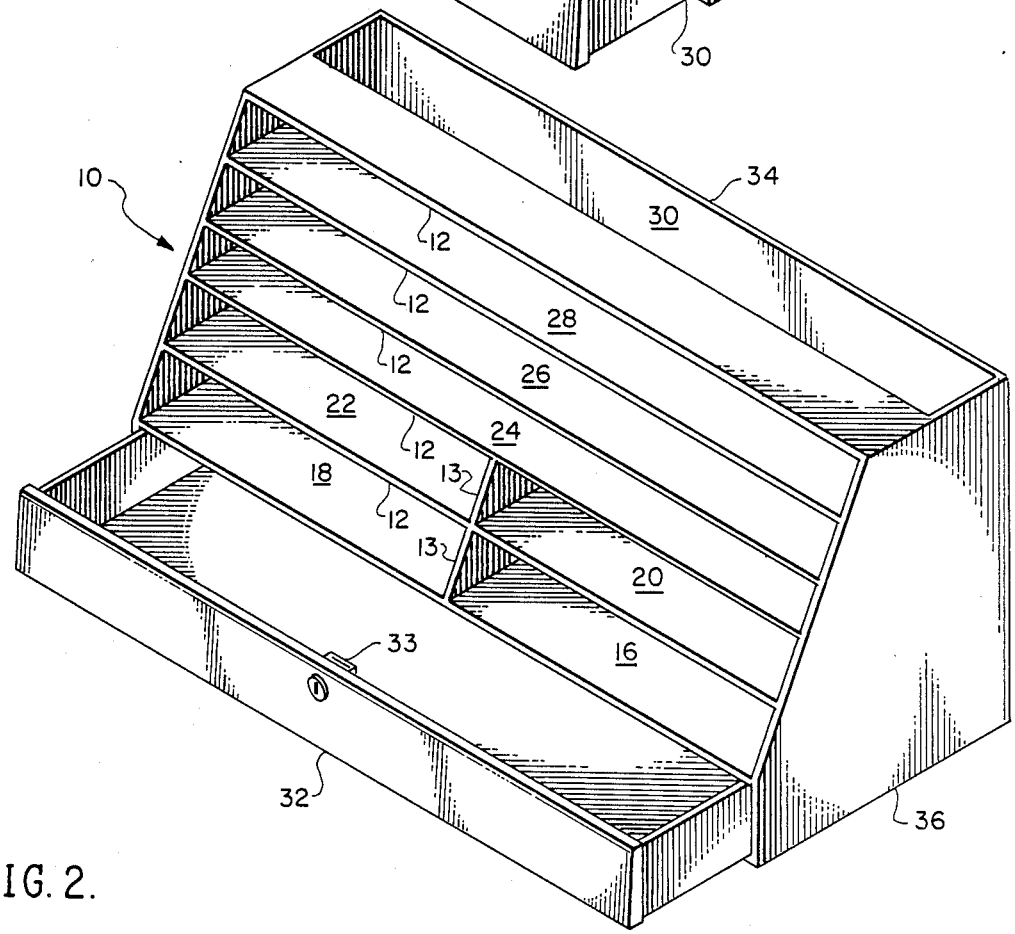
FIG. 2 is a perspective view of the novel cabinet shown in FIG. 1 with the dividers horizontal and the lockable storage drawer also in a horizontal position.

In addition, referring to the embodiment disclosed in the drawing, the drawer receiving slots 14 and 30, when they are not in position to receive the drawer 32 are always juxtaposed to the back wall of the cabinet regardless of its orientation while the other drawer receiving slot is horizontal in the cabinet. The drawer 32 with lock 33 is preferably utilized in its horizontal position either in slot 14 or slot 30 regardless of the placement of the cabinet 10. This is apparent by referring to FIG. 1 where it is seen that the cabinet rests on base wall 34 and has a back wall 36 and connecting side walls 38. Referring to FIG. 2, when the cabinet is rotated 90 degrees so that the wall 36 becomes the base wall of the cabinet the storage slots 16 through 28 are horizontal.

From the foregoing description, it will therefore be understood that this invention provides a utilitarian cabinet which can be utilized in two different positions whereby its apertures or storage slots can be utilized vertically or horizontally and its back becomes its base when its apertures are used as horizontal pigeonholes or vice versa, and one or more lockable drawers can be inserted horizontally in one or more drawer receiving slots in either position of the cabinet.

Having described the invention, what I claim as new is:

1. A two position cabinet having a base wall, a rear wall and connecting side walls, a plurality of dividers dividing the cabinet into a plurality of article receiving slots, said cabinet having at least one pair of identically sized drawer receiving slots, each said drawer receiving slot being defined by a width, length, and depth dimension, the corresponding width, length, and depth dimension of each said drawer receiving slot being identical, each sized to receive a drawer, the drawer receiving slots in each pair are perpendicular to each other and positioned so that whether the cabinet is in one position or the other, one drawer receiving slot in a pair is always vertical and the other drawer receiving slot in the pair is always horizontal in the cabinet, whereby in one position the base wall of the cabinet rests on a supporting surface and the rear wall connects the side walls of the cabinet together and the article receiving slots are vertical, and in a second position the cabinet is transverse to the first position so what used to be the base wall is now the back wall connecting the side walls of the cabinet together, and what used to be the rear wall is now the base wall, while the article receiving slots are horizontal, and a drawer is inserted in the horizontal drawer receiving slot.

2. A two position cabinet for displaying articles in a vertical position or a horizontal position, a plurality of divider walls dividing the cabinet into a plurality of differently sized article receiving slots so that when the cabinet is in one position the articles will be displayed in a vertical position and when the cabinet is in the other position the articles will be displayed in a horizontal position, said cabinet having at least one pair of identically sized drawer receiving slots, each said drawer receiving slot being defined by a width, length, and depth dimension, the corresponding width, length, and depth dimension of each drawer receiving slot being identical, the slots in each pair transverse to each other and sized to receive a drawer, said drawer receiving slots positioned so that regardless of whether the cabinet is in one position or in a transverse position, one of the drawer receiving slots is along a wall of the cabinet and the other drawer receiving slot is in a horizontal position adapted to receive a drawer.

3. The two position cabinet described in claim 2 wherein a drawer is inserted in the drawer receiving slot at the front of the cabinet.

* * * * *